US005882222A

United States Patent [19]

Hanami

[11] Patent Number: 5,882,222

[45] Date of Patent: Mar. 16, 1999

[54] ELECTRICAL CONNECTOR

[75] Inventor: Chiyoki Hanami, Tokyo, Japan

[73] Assignee: Hirose Electric Co., Ltd., Tokyo, Japan

[21] Appl. No.: 890,937

[22] Filed: Jul. 10, 1997

[30] Foreign Application Priority Data

Jul. 16, 1996 [JP] Japan ..... 8-204134

[51] Int. Cl.[6] ..... H01R 4/24

[52] U.S. Cl. ..... 439/418

[58] Field of Search ..... 439/418, 460, 439/449, 456, 465, 459

[56] References Cited

U.S. PATENT DOCUMENTS 4,193,658 3/1980 Dittmann et al. ..... 439/418

4,875,875 10/1989 Archer et al. ..... 439/465

*Primary Examiner*—Steven L. Stephan

*Assistant Examiner*—Yong Ki Kim

*Attorney, Agent, or Firm*—Kanesaka & Takeuchi

[57] ABSTRACT

An electrical connector includes a housing body (1) having an arranging section (5) in which a cable with a core wire (C1) consisting of a plurality of strands is placed; a retainer body (2) having contact elements (3) with a blade-like press contact section (12) so that when the retainer body is fitted in the housing body,.the press contact section cuts into the core wire for making press connection; a stepped-down portion (7) provided in the arranging section of the housing body near a position of the press connection; and a press section (10) extending as downwardly from the retainer body to a level less than a tip of the press contact section to press the cable so that the cable is bent along the stepped-down portion.

2 Claims, 3 Drawing Sheets

ELECTRICAL CONNECTOR

BACKGROUND OF THE INVENTION

1. Field of the Invention

The present invention relates to electrical connectors and, more particularly, to an electrical connector with a contact element having a blade-like press connecting portion.

2. Description of the Related Art

FIG. 3 shows such an electrical connector as described above. The connector 50 includes a housing body 51 made from an insulation material and a retainer body 53 having a contact element 52 and is inserted into the housing body 51 from above.

A plurality of arranging grooves 54 are provided in the bottom of the housing body 51 to receive a plurality of insulated conductors C arranged side by side in a first direction perpendicular to the sheet such that the insulated conductors project from the housing to the right. The core wires C1 of the insulated conductors C are made from twisted strands.

The contact elements 52 are provided in the retainer body 53 at positions corresponding to the respective insulated conductors C. The contact elements 52 are made by stamping a metal sheet so as to have a surface parallel to the sheet, two substantially triangular, blade-like press connect portions 55, and a J-shaped resilient contact portion 56, which projects into a recess 57 of the retainer body 53.

A mating connector 60 to be connected to the connector 50 includes a housing 61 having a raised section 62 and a contact element 63 provided in the raised section. The contact element 63 has a contact portion 64 placed on a side wall of the raised section 62 and a connection portion 65 projecting from the housing 61. The housing 61 has a guide section 66 to be guided by a guiding groove 58 of the connector 50.

In use, insulated conductors C are placed in the arranging grooves 54 of the housing body 51, and the retainer body 53 having the contact elements 52 is fitted in the housing body 51 so that the press contact portions 55 cut into the core wires Cl of the insulated conductors C. Thus, the press connection between the contact elements 52 and the insulated conductors C is completed.

The contact elements 52 are made from a thin metal sheet so that the press connection portions 55 enter the stranded wire without difficulty. However, the respective strands are waved so that they can be loosely connected to the press contact portions 55 and, when there is a temperature change or cable vibration, the resistance can become unstable. In addition, the strength with which the insulated conductor C is connected to the connector 50 is not always satisfactory.

SUMMARY OF THE INVENTION

Accordingly, it is an object of the invention to provide an electrical connector with a press contact portion able to make firm contact with a stranded wire so as to keep resistance stable and increase the strength with which the insulated conductor is attached to the housing.

According to the invention there is provided an electrical connector which includes a housing body having an arranging section in which a insulated conductor with a core wire consisting of a plurality of strands is placed; a retainer body having contact elements with a blade-like press contact section so that when the retainer body is fitted in the housing body, the press contact section cuts into the core wire for making press connection; a stepped portion provided in the arranging section of the housing body near a position of the press connection; and a press section extending downwardly from the retainer body to a level less than a tip of the press contact section to press the insulated conductor so that the insulated conductor is bent along the stepped portion.

The retainer body having contact elements is fitted in the housing body having insulated conductors arranged in the grooves so that the contact elements are press connected to the insulated conductors. The press contact sections of the contact elements cut into the insulated conductors, and the press section of the retainer body presses down the insulated conductor against the stepped-down portion and bend the insulated conductor. Consequently, the core wires are pulled and straightened so that the contact area and pressure against the press contact sections are increased, making the electrical resistance stable. In addition, the insulated conductors are also held by the press section, thereby increasing the strength with which the insulated conductors are fixed.

DESCRIPTION OF THE PREFERRED EMBODIMENT

Figure 1:
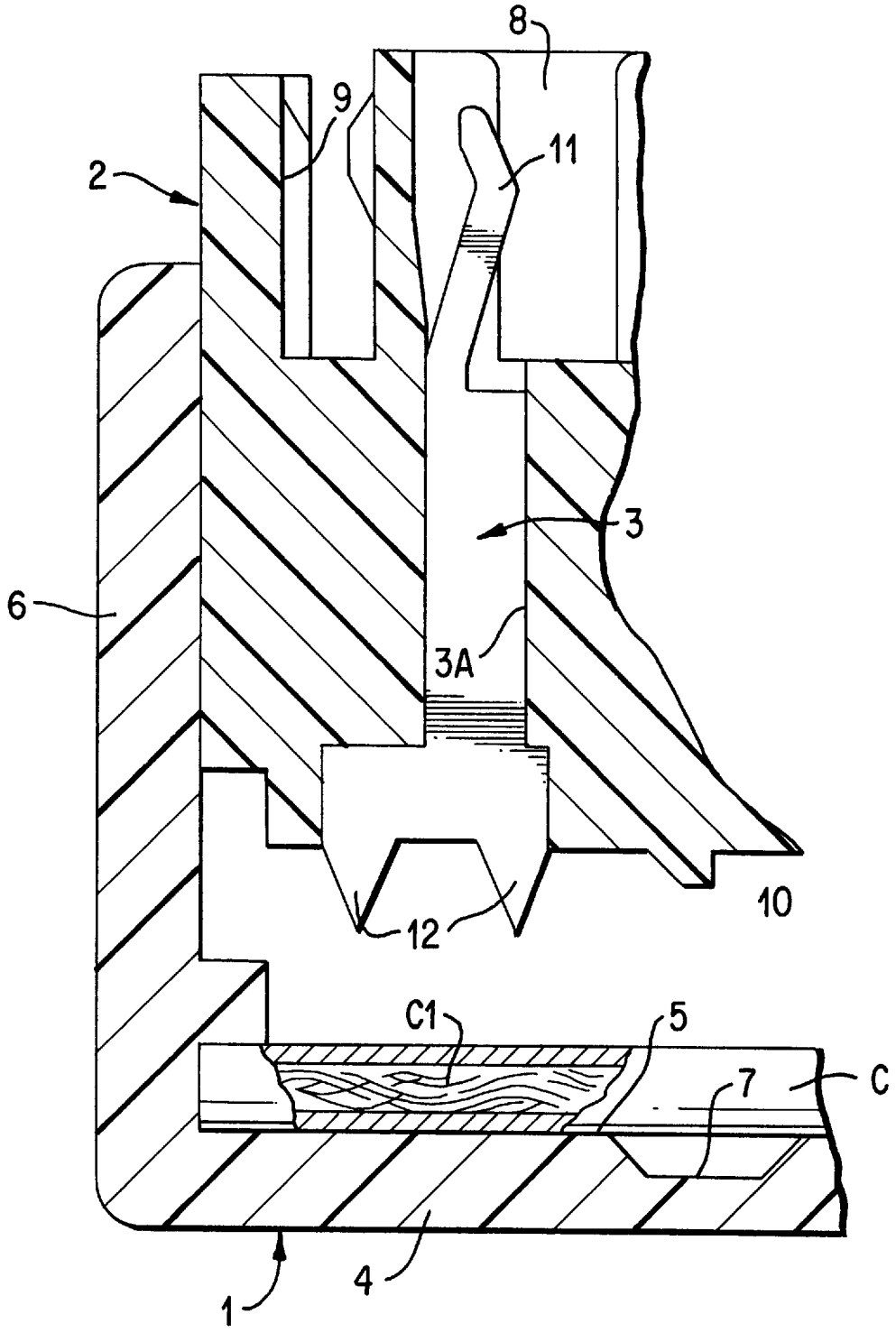
FIG. 1 is a sectional view of a connector according to an embodiment of the invention, wherein a retainer body is being fitted into a housing body.

In FIG. 1, a retainer body 2 having contact elements 3 is being fitted into a housing body 1. The housing body 1 is made from an insulation material so as to have an arranging section 5 on a bottom 4 for receiving insulated conductors C. Three side walls 6 extend upward from the bottom wall 4, and insulated conductor grooves extend from left to right and arranged with a predetermined pitch in the first direction perpendicular to the sheet to constitute the arranging section 5 for retaining the insulated conductors C.

A stepped-down channel 7 extends in the first direction in the arranging section 5. Alternatively, the stepped-down channel 7 may be a mere stepped shoulder or multiple stepped-down channel. Moreover, separate stepped-down channels may be provided for the respective insulated conductors grooves.

Similar to the housing body 1, the retainer body 2 is made from an insulation material so as to have retaining slits 3A extending vertically to retain respective contact elements 3 at positions corresponding to the insulated conductors C arranged in the arranging grooves 5, a recess 8 for receiving a mating connector, and a guide groove 9 for guiding the mating connector. A press portion 10 extends downward from the bottom of the retainer body 2 for press the insulated conductors C against the stepped-down channel 7, especially against the left bank of the stepped-down channel 7. The press portion 10 has a substantially saw-tooth shaped cross-section and extends in the first direction. However, the shape of cross-section varies with the cross-section of the stepped portion of the housing body 1.

The contact element 3 has a contact section 11 for contact with the contact element of a mating connector and two triangular blade-like press connection sections 12 and is press fitted into the retaining aperture 3A of the retaining body 2. The contact element 3 is similar to the contact element 52 of FIG. 1 and the detailed description is omitted. The press contact sections 12 of the contact element 3 project more than the press section 10. That is, the press section 10 extends from the bottom or base of the retainer body 2 to a level less than the press contact section 12.

How to use the connector will now be described below.

Figure 2:
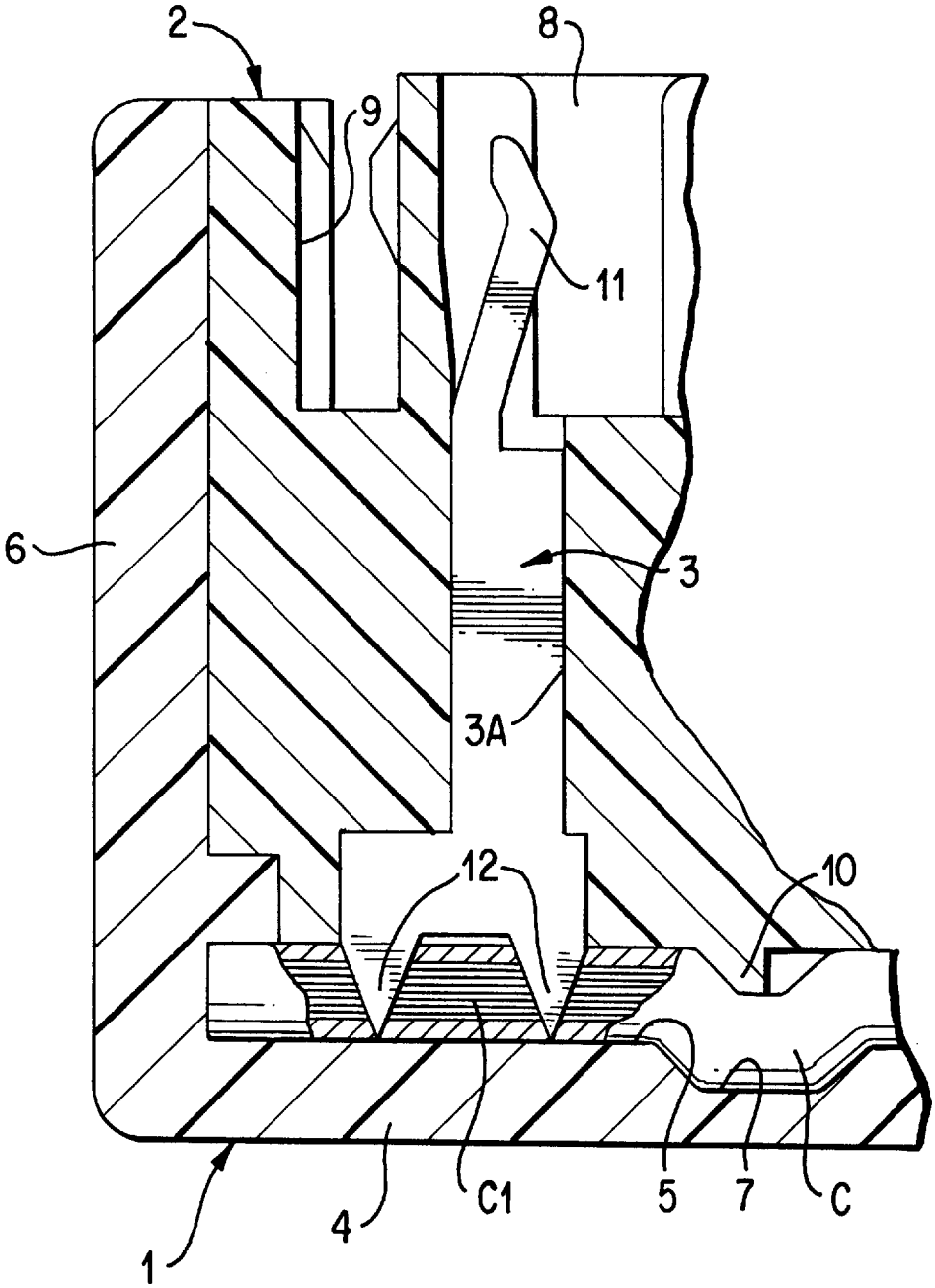
FIG. 2 is a sectional view of the connector, wherein the retainer body has been fitted in the housing.
Figure 3:
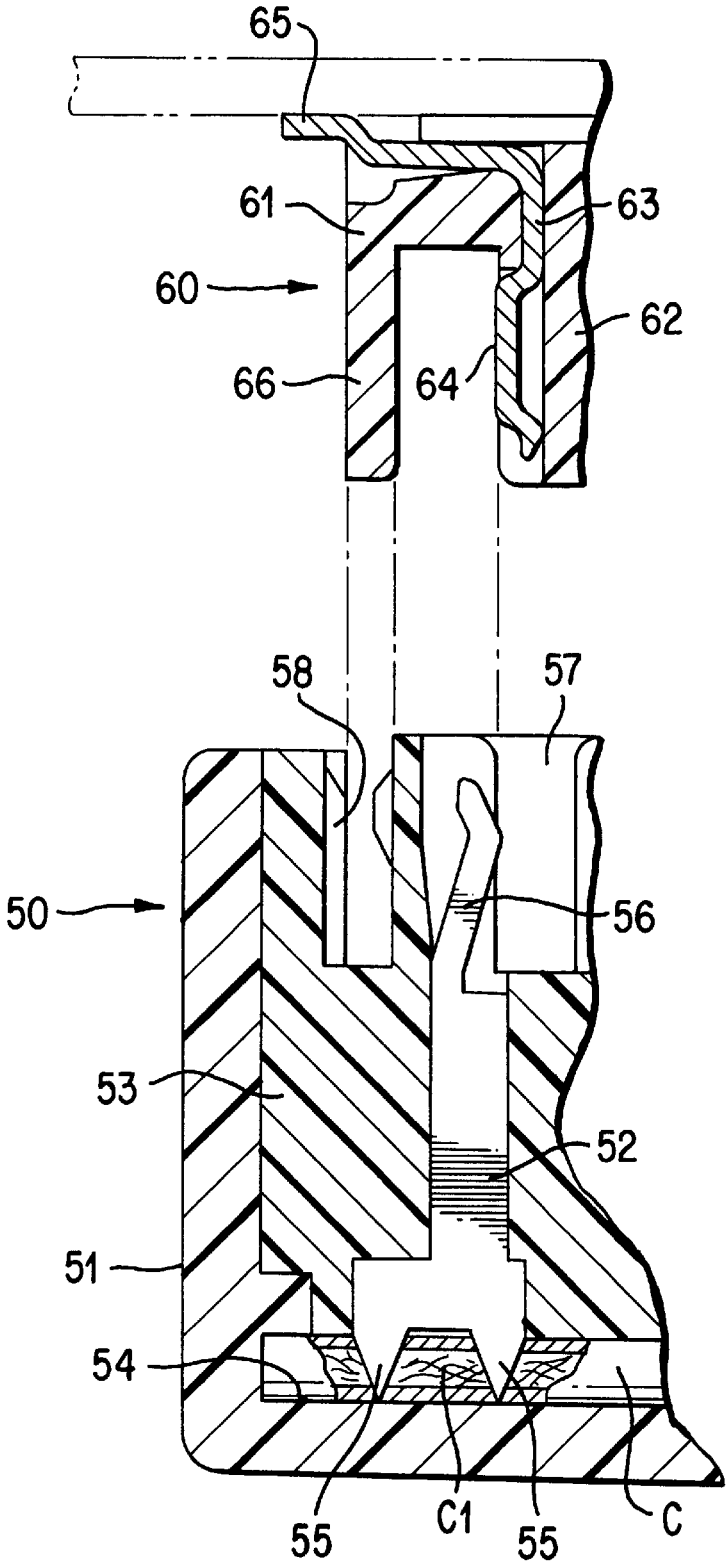
FIG. 3 PRIOR ART
FIG. 3 is a sectional view of a conventional connector and a mating connector.

Insulated conductors C are placed in the respective grooves of the arranging section 5. As FIG. 2 shows, the retainer body 2 having contact elements 3 is fitted into the housing body 1 and then pressed down so that the press contact sections 12 cut into the insulated conductors C and the press section 10 presses down the insulated conductors C. That is, the press contact section 12 prevents the insulated conductor C from moving in the longitudinally direction, and the press section 10 press down and pulls the insulated conductor C to the right so that the strands of the core wire C1 are straightened. Consequently, the press connection sections 12 are brought into close contact with the strands, making the contact stable, while the press section 10 firmly holds the insulated conductor C.

As has been described above, the stepped-down portion is provided in the housing body, and the press section is provided on the retainer body at the position corresponding to the stepped portion so that the press section bends the insulated conductor or applies a pull to the and the core wire. Consequently, the strands are brought into close contact with the press contact sections so that the electrical resistance is stable even if there is a temperature change or tension in the insulated conductor and the strength with which the insulated conductor is fixed to the connector is enhanced, resulting in the more reliable connector.

What is claimed is:

1. An electrical connector for a cable having at least one insulated conductor which includes a plurality of strands, comprising:

a housing body having an arranging section in which said insulated conductor is placed;

a retainer body having contact elements with a blade-like press contact section so that when said retainer body is fitted in the housing body, said press contact section cuts into said insulated conductor for making press contact with said strands;

stepped-down means provided in said arranging section of said housing body near a position of said press contact for receiving said insulated conductor; and press means extending downwardly from said retainer body to a level less than a tip of said press contact section to press down said insulated conductor so that said insulated conductor is bent along said stepped-down means to thereby pull and straighten said strands, assuring stable electrical connection between said press contact section and said strands.

2. An electrical connector according to claim 1, wherein said stepped-down means is a channel having left and right banks and a bottom between them and said press means is a projection having a left inclined sidewall so that when said retainer body is fitted into said housing, said left inclined sidewall and said left bank of said channel sandwiches and pull said strands to a right side to straighten said strands, thereby assuring said stable electrical connection.

* * * * *